US010619272B2

(12) United States Patent
Bloom

(10) Patent No.: US 10,619,272 B2
(45) Date of Patent: Apr. 14, 2020

(54) HIGH LOAD BEARING CAPACITY NYLON STAPLE FIBER AND NYLON BLENDED YARNS AND FABRICS MADE THEREFROM

(71) Applicant: INVISTA NORTH AMERICA S.A.R.L., Wilmington, DE (US)

(72) Inventor: Douglas A. Bloom, Seaford, DE (US)

(73) Assignee: INVISTA North America S.a.r.l., Wilmington, DE (US)

( * ) Notice: Subject to any disclaimer, the term of this patent is extended or adjusted under 35 U.S.C. 154(b) by 49 days.

(21) Appl. No.: 15/958,250

(22) Filed: Apr. 20, 2018

(65) Prior Publication Data

US 2018/0340275 A1 Nov. 29, 2018

Related U.S. Application Data

(62) Division of application No. 13/120,687, filed as application No. PCT/US2009/060373 on Oct. 12, 2009, now abandoned.

(60) Provisional application No. 61/104,397, filed on Oct. 10, 2008.

(51) Int. Cl.

| | |
|---|---|
| ***D03D 15/00*** | (2006.01) |
| ***D02G 3/00*** | (2006.01) |
| ***D01D 5/08*** | (2006.01) |
| ***D01D 5/16*** | (2006.01) |
| ***D01D 5/26*** | (2006.01) |
| ***D01F 6/60*** | (2006.01) |
| ***D02G 3/04*** | (2006.01) |
| ***D02G 3/44*** | (2006.01) |
| ***D03D 1/00*** | (2006.01) |
| ***D03D 15/12*** | (2006.01) |

(52) U.S. Cl.

CPC ..... *D03D 15/00* (2013.01); *D01D 5/16* (2013.01); *D01D 5/26* (2013.01); *D01F 6/60* (2013.01); *D02G 3/04* (2013.01); *D02G 3/442* (2013.01); *D03D 1/0041* (2013.01); *D03D 15/12* (2013.01); *D10B 2201/02* (2013.01); *D10B 2201/24* (2013.01); *D10B 2211/02* (2013.01); *D10B 2321/041* (2013.01); *D10B 2321/101* (2013.01); *D10B 2331/02* (2013.01); *D10B 2331/021* (2013.01); *D10B 2401/063* (2013.01); *D10B 2401/16* (2013.01); *Y10T 428/298* (2015.01); *Y10T 428/2913* (2015.01); *Y10T 442/30* (2015.04); *Y10T 442/313* (2015.04)

(58) Field of Classification Search

None

See application file for complete search history.

(56) References Cited

U.S. PATENT DOCUMENTS

| | | | | |
|---|---|---|---|---|
| 3,022,539 A | | 2/1962 | Massey | |
| 3,044,250 A | | 7/1962 | Hebeler | |
| 3,070,839 A | | 1/1963 | Thompson | |
| 3,108,322 A | | 10/1963 | Tate | |
| 3,188,790 A | | 6/1965 | Hebeler | |
| 3,321,448 A | | 5/1967 | Hebeler | |
| 3,336,634 A | | 8/1967 | Brownley et al. | |
| 3,459,845 A | | 8/1969 | Hebeler | |
| 3,551,548 A | | 12/1970 | Brignac et al. | |
| 3,936,253 A | | 2/1976 | Fisher et al. | |
| 4,045,534 A | | 8/1977 | Fisher et al. | |
| 4,248,581 A | | 2/1981 | Harrison | |
| 4,794,680 A | | 1/1989 | Meyerhoff et al. | |
| 4,920,000 A | | 4/1990 | Green | |
| 5,011,645 A | * | 4/1991 | Thompson, Jr. ..... | D02J 1/22 264/210.7 |
| 5,077,124 A | | 12/1991 | Clark, III et al. | |
| 5,093,195 A | | 3/1992 | Thompson, Jr. | |
| 5,106,946 A | | 4/1992 | Clark, III et al. | |
| 5,139,729 A | | 8/1992 | Clark, III et al. | |
| 5,219,585 A | | 6/1993 | Shealy et al. | |
| 5,236,652 A | | 8/1993 | Kidder | |
| 5,364,701 A | | 11/1994 | Boles et al. | |
| 5,824,248 A | | 10/1998 | Sweet et al. | |

(Continued)

FOREIGN PATENT DOCUMENTS

| | | |
|---|---|---|
| CN | 102245818 A | 11/2011 |
| CN | 102245819 A | 11/2011 |

(Continued)

OTHER PUBLICATIONS

Ziabicki et al., "Fundamentals of Fibre Formation", The Science of Fibre Spinning and Drawing, J. Wiley & Sons, 1976, pp. 196-241.

(Continued)

*Primary Examiner* — Shawn Mckinnon

(74) *Attorney, Agent, or Firm* — Invista North America S.A.R.L.

(57) ABSTRACT

Disclosed is the preparation of improved high strength nylon staple fibers having a denier per filament of 1.0 to 3.0, a tenacity T at break of at least about 6.0, and a load-bearing capacity, $T_7$, of greater than 3.2. Such nylon staple fibers are produced by preparing tows of relatively uniformly spun and quenched nylon filaments, drawing and annealing such tows via a two-stage drawing and annealing operation using relatively high draw ratios and then cutting or otherwise converting the drawn and annealed tows into the desired high strength nylon staple fibers.

The nylon staple fibers so prepared can be blended with other fibers such as cotton staple fibers to produce nylon/cotton (NYCO) yarns which are also of desirably high strength.

11 Claims, No Drawings

(56) References Cited

U.S. PATENT DOCUMENTS

| | | | | |
|---|---|---|---|---|
| 5,866,050 | A | 2/1999 | Krauss et al. | |
| 6,057,032 | A | 5/2000 | Green | |
| 6,090,485 | A | 7/2000 | Anderson et al. | |
| 6,235,390 | B1 | 5/2001 | Schwinn et al. | |
| 6,605,694 | B2 | 8/2003 | Schwinn et al. | |
| 6,627,129 | B1 | 9/2003 | Schwinn et al. | |
| 6,814,939 | B2 | 11/2004 | Schwinn et al. | |
| 6,881,047 | B2 | 4/2005 | Smith et al. | |
| 6,926,854 | B2 | 8/2005 | Jen | |
| 2007/0128404 | A1 | 6/2007 | Tung et al. | |
| 2009/0124149 | A1* | 5/2009 | Barnes | D01D 5/16 442/59 |
| 2011/0177737 | A1 | 7/2011 | Bloom et al. | |
| 2011/0177738 | A1 | 7/2011 | Bloom et al. | |

FOREIGN PATENT DOCUMENTS

| | | | |
|---|---|---|---|
| CN | 102245818 | B | 10/2014 |
| CN | 102245819 | B | 12/2014 |
| EP | 2334855 | A2 | 6/2011 |
| EP | 2347042 | A2 | 7/2011 |
| EP | 2334855 | A4 | 4/2012 |
| EP | 2347042 | A4 | 4/2012 |
| EP | 2347042 | B1 | 8/2017 |
| KR | 1020070089736 | A | 8/2007 |
| KR | 2011-0069152 | A | 6/2011 |
| KR | 2011-0069153 | A | 6/2011 |
| KR | 10-1670525 | B1 | 11/2016 |
| MX | 2011003639 | A | 5/2011 |
| MX | 2011003640 | A | 5/2011 |
| MX | 341673 | B | 8/2016 |
| MX | 345584 | B | 2/2017 |
| RU | 2011118363 | A | 11/2012 |
| RU | 2011118364 | A | 11/2012 |
| RU | 2514757 | C2 | 5/2014 |
| RU | 2514760 | C2 | 5/2014 |
| WO | 2010/042928 | A2 | 4/2010 |
| WO | 2010/042929 | A2 | 4/2010 |
| WO | 2010/042928 | A3 | 7/2010 |
| WO | 2010/042929 | A3 | 8/2010 |
| WO | 2010/042928 | A4 | 9/2010 |

OTHER PUBLICATIONS

Gutmann et al., "Improvement of Polyamide Yarn Properties by Processing Polyarnide Blends", Chemical Fibers International, vol. 46, No. 6, Dec. 1996, pp. 418-420.

Zeitz et al., "Textile and Bearing Technology for Separator Rolls", International Fiber Journal, vol. 17, Feb. 1, 2002, pp. 66-67.

International Search Report and Written Opinion Received for PCT Patent Application No. PCT/US2009/060373, dated Apr. 30, 2010, 7 pages.

International Preliminary Report on Patentability Received for PCT Patent Application No. PCT/US2009/060373, dated Apr. 21, 2011, 6 pages.

Restriction Requirement Received for Related U.S. Appl. No. 13/120,687, dated Jun. 9, 2014, 8 pages.

Final Office Action Received for Related U.S. Appl. No. 13/120,687, dated Dec. 1, 2015, 10 pages.

Non Final Office Action Received for Related U.S. Appl. No. 13/120,687, dated Jul. 26, 2017, 9 pages.

Final Office Action Received for Related U.S. Appl. No. 13/120,687, dated Jan. 26, 2018, 10 pages.

Restriction Requirement Received for Related U.S. Appl. No. 13/120,698, dated May 23, 2014, 8 pages.

Non Final Office Action Received for Related U.S. Appl. No. 13/120,698, dated Jun. 26, 2015, 12 pages.

Extended European Search Report Received for EP Application No. 09820032.0, dated Mar. 23, 2012, 7 pages.

Extended European Search Report Received for EP Application No. 09820033.0, dated Mar. 26, 2012, 7 pages.

Chinese Office Action Received for Chinese Application No. 200980150343.3, dated Mar. 1, 2013, 14 pages, (9 pages of English translation + 5 Pages official copy).

Chinese Office Action Received for Chinese Application No. 200930150307.7, dated Aug. 14, 2012, 14 pages, (9 pages of English translation + 5 Pages official copy).

Chinese Office Action Received for Chinese Application No. 200930150307.7, dated May 23, 2013, 7 pages, (4 pages of English translation + 3 Pages official copy).

Chinese Office Action Received for Chinese Application No. 200980150307.7, dated Feb. 7, 2014, 7 pages, (4 pages of English translation 3 Pages official copy).

Chinese Office Action Received for Chinese Application No. 200980150343.3, dated Feb. 26, 2014, 9 pages, (5 pages of English translation + 4 Pages official copy).

International Search Report and Written Opinion received for PCT Patent Application No. PCT/US2009/060377, dated Jul. 6, 2010, 6 pages.

International Preliminary Report and Patentability Report received for PCT Patent Application No. PCTUS2009/060377, dated Apr. 21, 2011, 5 pages.

* cited by examiner

HIGH LOAD BEARING CAPACITY NYLON STAPLE FIBER AND NYLON BLENDED YARNS AND FABRICS MADE THEREFROM

INTRODUCTION

This application is a divisional of U.S. application Ser. No. 13/120,687 filed Mar. 24, 2011, which is the National Stage of International Application No. PCT/US2009/060373 filed Oct. 12, 2009, which claims benefit of priority to U.S. Provisional Application Ser. No. 61/104,397 filed Oct. 10, 2008, the contents of which are incorporated herein by reference in their entireties.

FIELD OF THE INVENTION

This invention relates to the preparation of improved nylon staple fiber of desirably high strength as quantified by load-bearing capacity. Such nylon staple fiber is produced by preparing tows of relatively uniformly spun and quenched nylon filaments, drawing and annealing such tows, and then cutting or otherwise converting the drawn and annealed tows into the desired high strength nylon staple fiber.

The nylon staple fiber so prepared can be blended with other fibers such as cotton staple fiber to produce yarns which are also of desirably high strength. Such yarns can then be woven into fabrics which can be advantageously lightweight, comfortable, lower cost, and durable and hence especially suitable for use in or as, for example, military apparel such as combat uniforms or other rugged use apparel.

BACKGROUND OF THE RELATED TECHNOLOGY

Nylon has been manufactured and used commercially for a number of years. The first nylon fibers were of nylon 6,6, poly(hexamethylene adipamide), and nylon 6,6 fiber is still made and used commercially as the main nylon fiber. Large quantities of other nylon fibers, especially nylon 6 fiber prepared from caprolactam, are also made and used commercially. Nylon fiber is used in yarns for textile fabrics, and for other purposes. For textile fabrics, there are essentially two main yarn categories, namely continuous filament yarns and yarns made from staple fiber, i.e. cut fiber.

Nylon staple fiber has conventionally been made by melt-spinning nylon polymer into filaments, collecting very large numbers of these filaments into a tow, subjecting the tow to a drawing operation and then converting the tow to staple fiber, e.g., in a staple cutter. The tow usually contains many thousands of filaments and is generally of the order of several hundred thousand (or more) in total denier. The drawing operation involves conveying the tow between a set of feed rolls and a set of draw rolls (operating at a higher speed than the feed rolls) to increase the orientation of nylon polymer in the filaments. Drawing is often combined with an annealing operation to increase nylon crystallinity in the tow filaments before the tow is converted into staple fiber.

One of the advantages of nylon staple fibers is that they are readily blended, particularly with natural fibers, such as cotton (often referred to as short staple) and/or with other synthetic fibers, to achieve the advantages derivable from such blending. A particularly desirable form of nylon staple fiber has been used for many years for blending with cotton, particularly to improve the durability and economics of the fabrics made from yarns comprising blends of cotton with nylon. This is because such nylon staple fiber has a relatively high load-bearing tenacity, as disclosed in Hebeler, U.S. Pat. Nos. 3,044,250; 3,188,790; 3,321,448; and 3,459,845, the disclosures of which are hereby entirely incorporated by reference. As explained by Hebeler, the load-bearing capacity of nylon staple fiber is conveniently measured as the tenacity at 7% elongation ($T_7$), and the $T_7$ parameter has long been accepted as a standard measurement and is easily read on an Instron machine.

The Hebeler process for preparing nylon staple fiber involves the nylon spinning, tow forming, drawing and converting operations hereinbefore described. Improvements in the Hebeler process for preparing nylon staple fiber have subsequently been made by modifying the nature of the tow drawing operation and by adding specific types of annealing (or high temperature treatment) and subsequent cooling steps to the overall process. For example, Thompson in U.S. Pat. Nos. 5,093,195 and 5,011,645 discloses nylon staple fiber preparation wherein nylon 6,6 polymer, having for example a formic acid relative viscosity (RV) of 55, is spun into filaments which are then drawn, annealed, cooled and cut into staple fiber having a tenacity, T, at break of about 6.8-6.9, a denier per filament of about 2.44, and a load-bearing capacity, $T_7$, of from about 2.4 to 3.2. Such nylon staple fibers are further disclosed in the Thompson patents as being blended with cotton and formed into yarns of improved yarn strength. (Both of these Thompson patents are incorporated herein by reference in their entirety.)

Nylon staple fibers prepared in accordance with the Thompson technology have been blended into NYCO yarns (generally at a 50:50 nylon/cotton ratio) with these yarns being used to prepare NYCO fabrics. Such NYCO fabrics, e.g., woven fabrics, find application in military combat uniforms and apparel. While such fabrics have generally proven satisfactory for military or other rugged apparel use, military authorities, for example, are continually looking for improved fabrics which may be lighter in weight, lower in cost and/or more comfortable but still highly durable or even of improved durability.

One route to such fabrics of improved durability and comfort and lighter weight could involve the preparation of NYCO yarns, and fabrics made therefrom, wherein the nylon staple fibers used in yarn preparation have improved load-bearing capacity in comparison with existing nylon staple fibers. Fabrics prepared from yarns using such improved load-bearing nylon staple fibers could advantageously be made to have equivalent or even improved durability in comparison with currently used fabrics. Nylon staple fibers of increased load-bearing capacity could provide such desirable durability performance by being incorporated into lighter weight and/or lower cost fabric which potentially uses less of the nylon staple fiber than is currently employed in such fabrics.

SUMMARY OF THE INVENTION

Given the foregoing considerations, some embodiments are directed to a process for preparing nylon staple fiber of desirably high load-bearing capacity, to such staple fibers themselves, and to yarns made by blending these nylon staple fibers with at least one companion staple fiber such as cotton staple fibers. The resulting yarns may be nylon/cotton (NYCO) yarns that can then be woven into durable, and optionally lightweight, woven NYCO fabrics which can be especially suitable for military or other rugged apparel use.

In its process aspects, some embodiments provide a process for preparing nylon staple fibers having a load-bearing capacity of greater than 3.2 grams per denier measured as tenacity ($T_7$) at 7% elongation. This process comprises the steps of melt-spinning nylon polymer into filaments, uniformly quenching the filaments and forming a tow from a multiplicity of these quenched filaments, subjecting the tow to drawing and annealing, and then converting the resulting drawn and annealed tow into staple fibers suitable for forming into, for example, spun yarn.

In accordance with the process aspects of some embodiments, the nylon polymer which is melt spun into filaments will have a formic acid relative viscosity (RV) of from 45 to 100, including from 55 to 100, from 46 to 65; from 50 to 60; and from 65 to 100. These nylon polymer filaments are spun, quenched and formed into tows with both positional uniformity and uniformity of quenching conditions which are sufficient to permit use of draw ratios that provide the desired eventual staple fiber $T_7$ tenacity greater than 3.2 grams per denier;

Further, the drawing and annealing of the tow is carried out in a two-stage continuous operation conducted at a total effective draw ratio of from about 2.3 to 5.0, including from 3.0 to 4.0. In a first drawing stage of this drawing operation, from 85% to 97.5% of the drawing of the tow occurs. In a second annealing and drawing stage of this operation, the tow is subjected to an annealing temperature of from 145° C. to 205° C. In one embodiment, the temperature of the tow in this annealing and drawing stage may be achieved by contacting the tow with a steam-heated metal plate that is positioned between the first stage draw and the second stage drawing and annealing operation. This drawing and annealing operation is then followed by a cooling step wherein the drawn and annealed tow is cooled to a temperature of less than 80° C. Throughout the two stage drawing and annealing operation, the tow is maintained under a controlled tension.

In another aspect, some embodiments are directed to nylon staple fibers of the type which can be prepared in accordance with the foregoing process. Thus, the nylon staple fibers of some embodiments are those which have a denier per filament of from 1.0 to 3.0, a tenacity of at least 6.0 grams per denier and a load-bearing capacity of greater than 3.2 grams per denier, measured as tenacity ($T_7$) at 7% elongation. These staple fibers can be fashioned from nylon polymer having a relative viscosity of from 45 to 100.

In another aspect, the some embodiments are directed to textile yarn which can be made by blending the nylon staple fibers herein with at least one companion fiber such as cotton staple fibers. The resulting yarn may be a nylon/cotton, i.e., NYCO, yarn which comprises both cotton staple fibers and nylon staple fibers in a weight ratio of cotton to nylon fibers which ranges from 20:80 to 80:20. The nylon staple fibers in the NYCO yarn are those which have a denier per filament of from 1.0 to 3.0, a tenacity of at least 6.0 grams per denier and a load bearing capacity of greater than 3.2 grams per denier, measured as tenacity ($T_7$) at 7% elongation.

In another aspect, some embodiments are directed to lightweight and desirably durable NYCO fabrics which are woven from the NYCO textile yarns hereinbefore described. Such fabrics are woven from textile yarns in both a warp and a weft (fill) direction. The yarns woven in at least one of these directions will be a yarn comprising blended nylon staple fibers herein and cotton staple fibers in a cotton fiber to nylon fiber weight ratio of from 20:80 to 80:20. Again, the nylon staple fibers in the textile yarns used to weave the NYCO fabrics herein are those which have a denier per filament of from 1.0 to 3.0, a tenacity of at least 6.0 grams per denier and a load-bearing capacity of greater than 3.2 grams per denier, measured as tenacity ($T_7$) at 7% elongation.

In still another aspect, some embodiments are directed to NYCO fabrics woven from textile yarns in both a warp and weft (fill) direction wherein these textile yarns woven in both directions comprise blended cotton staple fibers and nylon staple fibers in a weight ratio of cotton staple fibers to nylon staple fibers ranging from 20:80 to 80:20. Further, in such fabrics the NYCO yarns woven in the weft (fill) direction comprise nylon staple fibers having a denier per filament of from 1.3 to 2.0, including from 1.6 to 1.8, and from 1.55 to 1.75, and the NYCO yarns woven in the warp direction comprise nylon staple fibers having a denier per filament of from 2.1 to 3.0 such as from 2.3 to 2.7.

DETAILED DESCRIPTION OF THE INVENTION

As used herein, the terms "durable" and "durability" refer to the propensity of a fabric so characterized to have suitably high grab and tear strength as well as resistance to abrasion for the intended end use of such fabric, and to retain such desirable properties for an appropriate length of time after fabric use has begun.

As used herein, the term blend or blended, in referring to a spun yarn, means a mixture of fibers of at least two types, wherein the mixture is formed in such a way that the individual fibers of each type of fiber are substantially completely intermixed with individual fibers of the other types to provide a substantially homogeneous mixture of fibers, having sufficient entanglement to maintain its integrity in further processing and use.

As used herein, cotton count refers to the yarn numbering system based on a length of 840 yards, and wherein the count of the yarn is equal to the number of 840-yard skeins required to weigh 1 pound.

All numerical values recited herein are understood to be modified by the term "about".

Some embodiments are based on the preparation of improved nylon staple fibers having certain specified characteristics and on the subsequent preparation of yarns, and fabrics woven from such yarns, wherein these improved nylon staple fibers are blended with at least one other fiber. The other fibers may include celluosics such as cotton, modified cellulosics such as FR treated celluose, polyester, rayon, animal fibers such as wool, fire resistant (FR) polyester, FR nylon, FR rayon, FR treated cellulose, m-aramid, p-aramid, modacrylic, novoloid, melamine, polyvinyl chloride, antistatic fiber, PBO (1,4-benzenedicarboxylic acid, polymer with 4,6-diamino-1, 3-benzenediol dihydrochloride), PBI (polybenzimidazole), and combinations thereof. The nylon staple fibers of some embodiments can provide an increase in strength and/or abrasion resistance to yarns and fabrics. This is especially true for combination with relatively weaker fibers such as cotton and wool.

The specific characteristics of the nylon staple fibers prepared and used herein include fiber denier, fiber tenacity and fiber load-bearing capacity defined in terms of fiber tenacity at 7% elongation.

Realization of the desired nylon staple fiber material herein is also based on the use in staple fiber manufacture of nylon polymeric filaments and tows having certain selected properties and processed using certain selected processing operations and conditions. The nylon polymer itself which is used for the spinning of nylon filaments can be produced in conventional manner. Nylon polymer suitable for use in the process and filaments of some embodiments consists of synthetic melt spinnable or melt spun polymer. Such nylon polymers can include polyamide homopolymers, copolymers, and mixtures thereof which are predominantly aliphatic, i.e., less than 85% of the amide-linkages of the polymer are attached to two aromatic rings. Widely-used polyamide polymers such as poly(hexamethylene adipamide) which is nylon 6,6 and poly(ε-caproamide) which is nylon 6 and their copolymers and mixtures can be used in accordance with some embodiments. Other polyamide polymers which may be advantageously used are nylon 12, nylon 4,6, nylon 6,10, nylon 6,12, nylon 12,12, and their copolymers and mixtures. Illustrative of polyamides and copolyamides which can be employed in the process, fibers, yarns and fabrics of some embodiments are those described in U.S. Pat. Nos. 5,077,124, 5,106,946, and 5,139,729 (each to Cofer et al.) and the polyamide polymer mixtures disclosed by Gutmann in Chemical Fibers International, pages 418-420, Volume 46, December 1996. These publications are all incorporated herein by reference.

Nylon polymer used in the preparation of nylon staple fibers has conventionally been prepared by reacting appropriate monomers, catalysts, antioxidants and other additives, such as plasticizers, delustrants, pigments, dyes, light stabilizers, heat stabilizers, antistatic agents for reducing static, additives for modifying dye ability, agents for modifying surface tension, etc. Polymerization has typically been carried out in a continuous polymerizer or batch autoclave. The molten polymer produced thereby has then typically been introduced to a spin pack wherein it is forced through a suitable spinneret and formed into filaments which are quenched and then formed into tows for ultimate processing into nylon staple fiber. As used herein, spin pack is comprised of a pack lid at the top of the pack, a spinneret plate at the bottom of the pack and a polymer filter holder sandwiched between the former two components. The filter holder has a central recess therein. The lid and the recess in the filter holder cooperate to define an enclosed pocket in which a polymer filter medium, such as sand, is received. There are provided channels interior to the pack to allow the flow of molten polymer, supplied by a pump or extruder to travel through the pack and ultimately through the spinneret plate. The spinneret plate has an array of small, precision bores extending therethrough which convey the polymer to the lower surface of the pack. The mouths of the bores form an array of orifices on the lower surface of the spinneret plate, which surface defines the top of the quench zone. The polymer exiting these orifices is in the form of filaments which are then directed downwards through the quench zone.

The extent of polymerization carried out in the continuous polymerizer or batch autoclave can generally be quantified by means of a parameter known as relative viscosity or RV. RV is the ratio of the viscosity of a solution of nylon polymer in a formic acid solvent to the viscosity of the formic acid solvent itself. Determination of RV is described in greater detail in the Test Methods section hereinafter. RV is taken as an indirect indication of nylon polymer molecular weight. For purposes herein, increasing nylon polymer RV is considered synonymous with increasing nylon polymer molecular weight.

As nylon molecular weight increases, its processing becomes more difficult due to the increasing viscosity of the nylon polymer. Accordingly, continuous polymerizers or batch autoclaves are typically operated to provide nylon polymer for eventual processing into staple fiber wherein the nylon polymer has an RV value of about 60 or less.

It is known that for some purposes, provision of nylon polymer of greater molecular weight, i.e., nylon polymer having RV values of greater than 70-75 and up to 140 or even 190 and higher can be advantageous. It is known, for example, that high RV nylon polymer of this type has improved resistance to flex abrasion and chemical degradation. Accordingly, such high RV nylon polymer is especially suitable for spinning into nylon staple fiber which can advantageously be used for the preparation of papermaking felts. Procedures and apparatus for making high RV nylon polymer and staple fiber therefrom are disclosed in U.S. Pat. No. 5,236,652 to Kidder and in U.S. Pat. Nos. 6,235,390; 6,605,694; 6,627,129 and 6,814,939 to Schwinn and West. All of these patents are incorporated herein by reference in their entirety.

In accordance with some embodiments, it has been discovered that staple fibers prepared from nylon polymer having an RV value which is generally consistent with, or in some cases higher than, that generally obtained via polymerization in a continuous polymerizer or batch autoclave, when processed in accordance with the spinning, quenching, drawing and annealing procedures described herein, unexpectedly exhibit improved load-bearing capacity as quantified by their $T_7$ tenacity at 7% elongation values. When such nylon staple fibers of improved load-bearing capacity are blended with one or more other fibers such as cotton staple fibers, textile yarns of improved strength can be realized. Fabrics such as NYCO fabrics woven from such yarns exhibit the advantages hereinbefore described with respect to durability, optional lighter weight, improved comfort and/or potential lower cost.

In accordance with the staple fiber preparation process herein, nylon polymer which is melt spun into tow-forming filaments through one or more spin pack spinnerets and quenched will have an RV value ranging from 45 to 100, including from 55 to 100, from 46 to 65; from 50 to 60; and from 65 to 100. Nylon polymer of such RV characteristics can be prepared, for example, using a melt blending of polyamide concentrate procedure such as the process disclosed in the aforementioned Kidder '652 patent. Kidder discloses certain embodiments in which the additive incorporated into the polyamide concentrate is a catalyst for the purpose of increasing the formic acid relative viscosity (RV). Higher RV nylon polymer available for melting and spinning, such as nylon having an RV of from 65 to 100, can also be provided by means of a solid phase polymerization (SPP) step wherein nylon polymer flakes or granules are conditioned to increase RV to the desired extent. Such solid phase polymerization (SPP) procedures are well-known and disclosed in greater detail in the aforementioned Schwinn/West '390, '694, '129 and '939 patents.

The nylon polymer material prepared as hereinbefore described and having the requisite RV characteristics as specified herein are fed to a spin pack, for example via a twin screw melter device. In the spin pack the nylon polymer is spun by extrusion through one or more spinnerets into a multiplicity of filaments. For purposes herein, the term "filament" is defined as a relatively flexible, macroscopically homogeneous body having a high ratio of length to width across its cross-sectional area perpendicular to its length. The filament cross section can be any shape, but is typically circular. Herein, the term "fiber" can also be used interchangeably with the term "filament".

Each individual spinneret position may contain from 100 to 1950 filaments in an area as small as 9 inches by 7 inches (22.9 cm×17.8 cm). Spin pack machines may contain from one to 96 positions, each of which provides bundles of filaments which eventually get combined into a single tow band for drawing/downstream processing with other tow bands.

After exiting the spinneret(s) of the spin pack, the molten filaments which have been extruded through each spinneret are typically passed through a quench zone wherein a variety of quenching conditions and configurations can be used to solidify the molten polymer filaments and render them suitable for collection together into tows. Quenching is most commonly carried out by passing a cooling gas, e.g., air, toward, onto, with, around and through the bundles of filaments being extruded into the quenching zone from each spinneret position within the spin pack.

One suitable quenching configuration is cross-flow quenching wherein the cooling gas such as air is forced into the quenching zone in a direction which is substantially perpendicular to the direction that the extruded filaments are travelling through the quench zone. Cross-flow quenching arrangements are described, among other quenching configurations, in U.S. Pat. Nos. 3,022,539; 3,070,839; 3,336,634; 5,824,248; 6,090,485, 6,881,047 and 6,926,854, all of which patents are incorporated herein by reference.

An important aspect of the staple fiber preparation process herein is that the extruded nylon filaments used to eventually form the desired nylon staple fibers should be spun, quenched and formed into tows with both positional uniformity and uniformity of quenching conditions which are sufficient to permit use of draw ratios that provide the desired eventual staple fiber $T_7$ tenacity greater than 3.2 grams per denier. Positional uniformity includes both within-position uniformity and position-to-position uniformity.

Both types of positional uniformity can be improved by carefully controlling temperature of the nylon polymer fed to the spin pack, as opposed to simply monitoring temperature of the heat exchange medium used to heat the polymer supply lines and pack wells. U.S. Pat. No. 5,866,050, incorporated herein by reference, discloses a method to better control nylon polymer temperature and refers to the importance of having a uniform polymer temperature. The specific method disclosed in order to achieve this result involves a first temperature control arrangement for heating the spin pack to a first predetermined reference temperature greater than the predetermined polymer inlet temperature such that the temperature across a polymer filter holder and the spinneret plate in the spin pack is substantially uniform. A plate assembly having at least one polymer flow passage therein is disposed between the outlet of the pump and the inlet of the spin pack. A second temperature control arrangement for independently controlling the temperature of the plate assembly to a second predetermined reference temperature is provided. The temperature control strategy and methods used in accordance with the invention disclosed herein is quite different as will be subsequently described.

Remelting of the polymer, e.g., in a twin screw melter, rather than feeding polymer from a continuous polymerization (CP) operation, can also help provide polymer to the spin pack and quench chimney(s) at a uniform controlled temperature. A twin screw melter has the ability to measure and control polymer temperature at various position-to-position locations prior to delivery to the spinneret versus a continuous polymerization unit which only measures heat exchange medium temperature at similar locations prior to the spinneret/pack. In connection with the development of the invention disclosed herein, it was observed that the variation of polymer temperature in the in the transit line between the polymerizer and the spin pack when run in continuous operation for an extended period of time was reduced from +/−2.5° C. to +/−0.6° C. when a continuous polymerizer operation was replaced by a twin screw melter. Polymer made from a continuous polymerizer also is known to contain gel which is degraded or cross-linked polymer. Gel can cause downstream drawing issues in terms of broken filaments. It is well known that use of a twin screw melter has been found to reduce the amount of gel versus a polymer supply from a CP unit. This is an example of features of the polymer supply which enable the extruded filaments to be made more uniformly and draw at higher ratios.

Spin center position-to-position filament bundle uniformity can also affect downstream draw processing. Sources of position-to-position filament bundle uniformity problems start with the machine and quench medium design. Use of fewer spin positions can facilitate improvements in position-to-position uniformity. Spin machines having 20 or fewer spinneret positions are easier to control with respect to maintenance of constant quench medium pressure along the length of the spin machine duct work, versus for example, 40 or even 96 positions. Fewer positions coupled with having the quench medium duct work reduced in length by approximately 50% from conventional practice allows for provision of a more uniform, non-turbulent quench medium supply to the spin center.

Another design feature of the spin center which facilitates uniform filament production relates to the quench medium filtering system. An improved quench air filter system, upstream of the spin center, continually monitors the pressure drop across the filters to control post filter air flow and pressure. Air flow and pressure are functions of the product spun.

Other design features of the spin center which can provide improved position-to-position filament uniformity is to have the pack/spinneret positioned exactly in the center of the quench chimney. All of these design features improve the position-to-position uniformity of the product being spun on the machine and contribute to improvements in the downstream drawing performance of tows formed from the filaments which are spun and quenched.

Within-position filament uniformity has the largest effect on downstream processing of tows and on obtaining the desired resulting staple fiber properties. Numerous prior art references discuss the problems encountered in obtaining filaments with uniform properties made at higher throughputs and using high filament density melt spinning processes. U.S. Pat. No. 4,248,581 mentions the quenching of filaments in a uniform manner and the difficulties associated with cross-flow quench. These same issues are also discussed in the '539, '839, '634, '248; '485, '047 and '854 patents hereinbefore referenced. Overcoming such within-position problems associated with uniformity of quenching conditions within the quenching zone is an important factor in permitting utilization of generally higher draw ratios in the subsequent drawing/annealing stage of the process herein.

In some cross-flow quenching operations, quench air is forced through the molten polymer filament bundles from one side of a rectangular filament array. Issues which can arise from this type of filament quenching are that the rows of filaments closest to the air flow quench first or quicker while the rows of filaments further from the air flow quench at a later time. It has also well-known that the quench air gets pulled with the filaments' downward movement and heated as it moves through the filament array or bundle. This contributes to uneven quenching of the molten filaments. Such uneven, non uniform quench can cause crystallization differences between the front, middle and back filaments. If this crystallization difference is large enough, it can cause fibers in the filament bundles to draw more or less. In other words, those filaments fully quenched early in the quench chimney versus later may not draw to the same ratio. This, in turn, can lead to excessive filament breaks when the tows formed from such non-uniform filaments are drawn at higher draw ratios or can limit the draw ratio that can be used due to inoperability of the draw machine.

As noted in the publication Ziabicki; "Fundamentals of Fibre Formation", (J Wiley &Sons), 1976, p 196 ff and p 241, the cooling conditions directly below the nozzle package are decisive for the thread quality. Ziabicki further points out that in the case of cross-flow quench, velocity measurements indicate that the bundle of threads exerts a considerable resistance to the quench air flow. Thus, the velocity of the air past the bundle is considerably reduced. This effect may stem from the fact that the blow air flows around the bundle instead of flowing through the same. Ziabicki also discloses that even more dramatic effects are observed in temperature distribution. The differences in air temperature measured before and beyond the bundle as well inside the bundle, can be substantial. He cites another study in which the structure and mechanical properties of filaments taken from various parts of the bundle were related to the range of air temperature in the individual parts of the bundle. Ziabicki concludes that the consequence of non-uniform structure is, as a rule, variation of yield stress and stress-strain characteristics. The consequence of this effect is that if material subjected to drawing consists of differing structure, the effective draw ratio in various sections will also be different.

Turbulent quench medium flow such as eddy currents can cause molten filaments to come in contact with one another and stick. These stuck fibers can also lead to downstream filament breakage problems.

To minimize problems of the foregoing types, the quenching zone or chamber used in the process of some embodiments should be designed and configured such that all of the filament bundles are exposed to substantially the same quenching conditions during the same time frame. An important factor in creating such uniform quenching conditions within the quenching zone relates to provision of controlled and uniform flow of the cooling gas, e.g., air, during its introduction into, flow through, and exit from the quenching zone or chamber.

A number of features can be used to improve the uniformity of quench air flow. Baffles can be positioned in the chimney to prevent air flowing around the bundle versus through the bundle. These baffles can be adjusted to also prevent eddy currents or turbulent air in the chimney that would normally result in stuck, molten filaments. Perforations in the chimney doors or tubes can also be used to better control turbulence of the quench medium. U.S. Pat. Nos. 3,108,322; 3,936,253 and 4,045,534, incorporated herein by reference, disclose the use of baffles and perforations in chimney quench systems to improve quench and reduce stuck filaments.

Another modification that can be used to improve positional uniformity is use of a monomer collection device that allows for positional adjustment as well as adjustment in terms of overall vacuum pulled across the machine. Such a device is disclosed in U.S. Pat. No. 5,219,585. A suitable monomer collection device can also have a larger rectangular opening that can be used to pull additional air if needed though the bundle but controlled to prevent filaments from leaving the bundle.

In the methods of some embodiments, a combination of some or all of the foregoing spinning and quenching features have been employed to ensure spun supply uniformity, i.e., more uniform undrawn fibers in terms of denier per filament, crystallinity, etc. Such fibers can accordingly be drawn more during the drawing/annealing step hereinafter described without an undue incidence of filament breaks. This in turn permits preparation of nylon staple fibers of higher tenacity at 7% elongation and at break.

The quenched spun filaments which have been formed using the foregoing uniformity-enhancing techniques can be combined into one or more tows. Such tows formed from filaments from one or more spinnerets are then subjected to a two stage continuous operation wherein the tows are drawn and annealed.

Drawing of the tows is generally carried out primarily in an initial or first drawing stage or zone wherein bands of tows are passed between a set of feed rolls and a set of draw rolls (operating at a higher speed) to increase the crystalline orientation of the filaments in the tow. The extent to which tows are drawn can be quantified by specifying a draw ratio which is the ratio of the higher peripheral speed of the draw rolls to the lower peripheral speed of the feed rolls. The effective draw ratio is calculated by multiplying the $1^{st}$ draw ratio and the $2^{nd}$ draw ratio.

The first drawing stage or zone may include several sets of feed and draw rolls as well as other tow guiding and tensioning rolls such as snubbing pins. Draw roll surfaces may be made of metal, e.g., chrome, or ceramic.

Ceramic draw roll surfaces have been found to be particularly advantageous in permitting use of the relatively higher draw ratios specified for use in connection with the staple fiber preparation process herein. Ceramic rolls improve roll life as well as provide a surface that is less prone to wrap. An article appearing the International Fiber Journal (International Fiber Journal, 17, 1, February 2002: "Textile and Bearing Technology for Separator Rolls, Zeitz and el.) as well as U.S. Pat. No. 4,794,680, both incorporated herein by reference, also disclose the use of ceramic rolls in to improve roll life and reduce fiber adherence to roll surface.

Particular arrangements of apparatus elements for effecting drawing of the tows are described in the hereinbefore mentioned Hebeler U.S. Pat. Nos. 3,044,250; 3,188,790; 3,321,448; and 3,459,845, and in Thompson U.S. Pat. Nos. 5,093,195 and 5,011,645, all of which patents are incorporated herein by reference. Ceramic rolls can, for example, be installed as some or all of the rolls labeled as Elements 12, 13 and 22 in FIG. 2 of the Thompson U.S. Pat. No. 5,093,195.

While the greatest extent of drawing of the tows of filaments herein takes place in the initial or first drawing stage or zone, some additional drawing of the tows will generally also take place in a second or annealing and drawing stage or zone hereinafter described. The total amount of draw to which the filament tows herein are subjected can be quantified by specifying a total effective draw ratio which takes into account drawing that occurs in both a first initial drawing stage or zone and in a second zone or stage where annealing and some additional drawing are conducted simultaneously.

In the process of some embodiments, the tows of nylon filaments are subjected to a total effective draw ratio of from 2.3 to 5.0, including from 3.0 to 4.0. In one embodiment wherein the denier per filament of the tows is generally smaller, a total effective draw ratio can range from 3.12 to 3.40. In another embodiment, wherein the denier per filament of the tows is generally larger, the total effective draw ratio can range from 3.5 to 4.0.

In the process herein, most of the drawing of the tows, as noted hereinbefore, occurs in the first or initial drawing stage or zone. In particular, from 85% to 97.5%, including from 92% to 97%, of the total amount of draw imparted to the tows will take place in the first or initial drawing stage or zone. The drawing operation in the first or initial stage will generally be carried out at whatever temperature the filaments have when passed from the quench zone of the melt spinning operation. Frequently, this first stage drawing temperature will range from 80° C. to 125° C.

From the first or initial drawing stage or zone, the partially drawn tows are passed to a second annealing and drawing stage or zone wherein the tows are simultaneously heated and further drawn. Heating of the tows to effect annealing serves to increase crystallinity of the nylon polymer of the filaments. In this second annealing and drawing stage or zone, the filaments of the tows are subjected to an annealing temperature of from 145° C. to 205° C., such as from 165° C. to 205° C. In one embodiment, the temperature of the tow in this annealing and drawing stage may be achieved by contacting the tow with a steam-heated metal plate that is positioned between the first stage draw and the second stage drawing and annealing operation.

After the annealing and drawing stage of the process herein, the drawn and annealed tows are cooled to a temperature of less than 80° C., such as less than 75° C. Throughout the drawing, annealing and cooling operations described herein, the tows are maintained under controlled tension and accordingly are not permitted to relax.

After drawing, annealing and cooling, the multifilament tows are converted into staple fiber in conventional manner, for example using a staple cutter. Staple fiber formed from the tows will frequently range in length from 2 to 13 cm (0.79 to 5.12 inches). For example, staple fibers may range from 2 to 12 cm (0.79 to 4.72 inches), from 2 to 12.7 cm (0.79 to 5.0 inches), or from 5 to 10 cm can be formed. The staple fiber herein can optionally be crimped.

The nylon staple fibers formed in accordance with the process herein will generally be provided as a collection of fibers, e.g., as bales of fibers, having a denier per fiber of from 1.0 to 3.0. When staple fibers having a denier per fiber of from 1.6 to 1.8, are to be prepared, a total effective draw ratio of from 3.12 to 3.40, such as from 3.15 to 3.30, can be used in the process herein to provide staple fibers of the requisite load-bearing capacity. When staple fibers having a denier per fiber of from 2.5 to 3.0 or 2.3 to 2.7 are to be prepared, a total effective draw ratio of from 3.5 to 4.0, or from 3.74 to 3.90, should be used in the process herein to provide staple fibers of the requisite load-bearing capacity.

The nylon staple fibers herein will have a load-bearing capacity of greater than 3.2 grams per denier, measured as tenacity ($T_7$) at 7% elongation. The $T_7$ values of the nylon staple fibers herein will range from 3.3 to 5.0 grams per denier, including from 3.3 to 4.0, from 3.4 to 3.7, and 3.3 to 4.5 grams per denier. The nylon staple fibers of some embodiments can have a tenacity T at break of at least 6.0 grams per denier, including a tenacity at break of greater than 6.2, 6.4, 6.8 or from 7.0 to 8.0 grams per denier.

The nylon staple fibers provided herein are especially useful for blending with other fibers for various types of textile applications. Blends can be made, for example, with the nylon staple fibers of some embodiments in combination with other synthetic fibers such as rayon or polyester. Examples of blends of the nylon staple fibers herein include those made with natural cellulosic fibers such as cotton, flax, hemp, jute and/or ramie. Suitable methods for intimately blending these fibers may include: bulk, mechanical blending of the staple fibers prior to carding; bulk mechanical blending of the staple fibers prior to and during carding; or at least two passes of draw frame blending of the staple fibers subsequent to carding and prior to yarn spinning.

In accordance with one embodiment, the high load-bearing capacity nylon staple fibers herein may be blended with cotton staple fibers and spun into textile yarn. Such yarns may be spun in conventional manner using commonly known short and long staple spinning methods including ring spinning, air jet or vortex spinning, open end spinning, or friction spinning. When the yarn blend includes cotton, the resulting textile yarn will generally have a cotton fiber to nylon fiber weight ratio of from 20:80 to 80:20, including from 40:60 to 60:40, and frequently a cotton:nylon weight ratio of 50:50. It is well-known in the art that nominal variation of the fiber content, e.g., 52:48 is also considered to be a 50:50 blend. Textile yarns made with the high load-bearing capacity nylon staple fibers herein will frequently exhibit LEA product values of at least 2800, such as at least 3000 at 50:50 NYCO content. Alternatively, such yarns may have a breaking tenacity of at least 17.5 or 18 cN/tex, including at least 19 cN/tex, at 50:50 NYCO content.

In one embodiment, the textile yarns herein will be made from nylon staple fibers having a denier per filament of from 1.6 to 1.8. In another embodiment, the textile yarns herein will be made from nylon staple fibers having a denier per filament of from 2.5 to 3.0, including from 2.3 to 2.7.

The nylon/cotton (NYCO) yarns of some embodiments can be used in conventional manner to prepare NYCO woven fabrics of especially desirable properties for use in military or other rugged use apparel. Thus such yarns may be woven into 2×1 or 3×1 twill NYCO fabrics. Spun NYCO yarns and 3×1 twill woven fabrics comprising such yarns are in general described and exemplified in U.S. Pat. No. 4,920,000 to Green. This '000 patent is incorporated herein by reference.

NYCO woven fabrics, of course, comprise both warp and weft (fill) yarns. The woven fabrics of some embodiments are those which have the NYCO textile yarns herein woven in an least one, and optionally both, of these directions. In one embodiment, fabrics herein of especially desirable durability and comfort will have yarns woven in the weft (fill) direction comprising nylon staple fibers herein which have a denier per filament of from 1.6 to 1.8 and will have yarns woven in the warp direction comprising nylon staple fibers herein which have a denier per filament of from 2.3 to 3.0, including from 2.5 to 3.0, and from 2.3 to 2.7 denier per filament.

The woven fabrics of some embodiments made using yarns which comprise the high load bearing nylon staple fibers herein can use less of the nylon staple fibers than conventional NYCO fabrics while retaining many of the desirable properties of such conventional NYCO fabrics. Thus, such fabrics can be made to be relatively lightweight and low cost while still desirably durable. Alternatively, such fabrics can be made using equal or even greater amounts of the nylon staple fibers herein in comparison with nylon fiber content of conventional NYCO fabrics with such fabrics herein providing superior durability properties.

Lightweight fabrics such as NYCO fabrics of some embodiments may have a fabric weight of less than 220 grams/$m^2$ (6.5 oz/$yd^2$), including less than 200 grams/$m^2$ (6.0 oz/$yd^2$), and less than 175 grams grams/$m^2$ (5.25 oz/$yd^2$). Suitable durable NYCO fabrics of the some embodiments will have a grab strength of 190 lbs or greater in the warp direction and 80 lbs or greater in the weft (fill) direction. Other durable fabrics have a Tear Strength in "as received" fabric in warp direction of 11.0 lbf (pound·foot) or greater and fill direction of 9.0 lbf or greater.

Other durable fabrics of some embodiments have a Taber Abrasion Resistance of at least 600 cycles to failure, including at least 1000 cycles to failure. Other durable fabrics of some embodiments will have a flex abrasion of 50,000 (cycles) or greater in warp and fill directions.

Test Methods

When the various parameters, properties and characteristics for the polymers, fibers, yarns and fabrics herein are specified, it is understood that such parameters, properties and characteristics can be determined using the following types of testing procedures and equipment:

Nylon Polymer Relative Viscosity

The formic acid RV of nylon materials used herein refers to the ratio of solution and solvent viscosities measured in a capillary viscometer at 25° C. The solvent is formic acid containing 10% by weight of water. The solution is 8.4% by weight nylon polymer dissolved in the solvent. This test is based on ASTM Standard Test Method D 789. The formic acid RVs are determined on spun filaments, prior to or after drawing, and can be referred to as spun fiber formic acid RVs.

Instron Measurements on Staple Fibers

All Instron measurements of staple fibers herein are made on single staple fibers, taking appropriate care with the clamping of the short fiber, and making an average of measurements on at least 10 fibers. Generally, at least 3 sets of measurements (each for 10 fibers) are averaged together to provide values for the parameters determined.

Filament Denier

Denier is the linear density of a filament expressed as weight in grams of 9000 meters of filament. Denier can be measured on a Vibroscope from Textechno of Munich, Germany. Denier times (10/9) is equal to decitex (dtex). Denier per filament can be determined gravimetrically in accordance with ASTM Standard Test Method D 1577.

Tenacity at Break

Tenacity at break (T) is the maximum or breaking force of a filament expressed as force per unit cross-sectional area. The tenacity can be measured on an Instron model 1130 available from Instron of Canton, Mass. and is reported as grams per denier (grams per dtex). Filament tenacity at break (and elongation at break) can be measured according to ASTM D 885.

Filament Tenacity at 7% Elongation

Filament tenacity at 7% elongation ($T_7$) is the force applied to a filament to achieve 7% elongation divided by filament denier. $T_7$ can be determined according to ASTM D 3822.

Yarn Strength

Strength of the spun nylon/cotton yarns herein can be quantified via a Lea Product value or yarn breaking tenacity. Lea Product and skein breaking tenacity are conventional measures of the average strength of a textile yarn and can be determined in accordance with ASTM D 1578. Lea Product values are reported in units of pounds force. Breaking tenacity is reported in units of cN/tex.

Fabric Weight

Fabric weight or basis weight of the woven fabrics herein can be determined by weighing fabric samples of known area and calculating weight or basis weight in terms of grams/m$^2$ or oz/yd$^2$ in accordance with the procedures of the standard test method of ASTM D 3776.

Fabric Grab Strength

Fabric grab strength can be measured in accordance with ASTM D 5034. Grab strength measurements are reported in pounds-force in both warp and fill directions.

Fabric Tear Strength—Elmendorf

Fabric tear strength can be measured in accordance with ASTM D 1424 titled Standard Test Method for Tearing Strength of Fabrics by Falling-Pendulum Type (Elmendorf) Apparatus. Grab strength measurements are reported in pounds-force in both warp and fill directions.

Fabric Abrasion Resistance—Taber

Fabric abrasion resistance can be determined as Taber abrasion resistance measured by ASTM D3884-01 titled Abrasion Resistance Using Rotary Platform Double Head Abrader. Results are reported in terms of cycles to failure.

Fabric Abrasion Resistance—Flex

Fabric abrasion resistance can be determined as Flex abrasion resistance measured by ASTM D3885 titled Standard Test Method for Abrasion Resistance of Textile Fabrics (Flexing and Abrasion Method). Results are reported in terms of cycles to failure.

The features and advantages of the present invention are more fully shown by the following examples which are provided for purposes of illustration, and are not to be construed as limiting the invention in any way.

EXAMPLES

In the examples herein, various nylon staple fibers are produced. The procedures used involve an SPP phase, a filament spinning phase, a drawing and annealing phase and a staple fiber production phase. Staple fibers so produced are then spun with cotton staple fibers into NYCO yarn.

In all instances, precursor nylon polymer flake is fed to a solid phase polymerization (SPP) vessel. The precursor flake polymer is homopolymer nylon 6,6 (polyhexamethylene adipamide) containing a polyamidation catalyst (i.e., manganous hypophosphite obtained from Occidental Chemical Company with offices in Niagara Falls, N.Y.) in concentration by weight of 16 parts per million. The precursor flake fed into the SPP vessel has a formic acid RV of about 48.

In the SPP vessel, conditioning gas is used to increase the RV of the nylon polymer flake to a value of about 55 employing apparatus and procedures similar to those disclosed by Schwinn in U.S. Pat. Nos. 6,814,939 and 6,605,694. This higher RV flake material is removed from the SPP vessel and is fed to a twin screw melter and then to a spin pack for melt spinning through a spinneret into filaments. The temperature of the polymer in the transfer line between the screw melter and the spin pack is maintained at 287 C+/−0.6. Filaments extruded through the spinneret are passed through a cross-flow quench zone supplied with quench air maintained at 45°-50° F. (7.2-12.8° C.) and then converged into a continuous filament tow.

The continuous filament tow is then drawn and annealed in a two stage operation similar to the apparatus and procedures described in U.S. Pat. No. 5,011,645. Various effective draw ratios are used in this two stage procedure as shown in Table 1. The temperature of the tow in this annealing and drawing stage was achieved by contacting the tow with a steam-heated metal plate that is positioned between the first stage draw and the second stage drawing and annealing operation. The drawn and annealed tow is then cooled to below 80° C. and is cut into nylon staple fibers having the characteristics shown in Table 1.

TABLE 1

| Example # | Effective Draw Ratio | DPF | Tenacity (T) (g/den) | Tenacity at 7% ($T_7$) (g/den) |
|---|---|---|---|---|
| 1 | 3.15 | 1.62 | 6.445 | 3.245 |
| 2 | 3.23 | 1.615 | 6.995 | 3.72 |
| 3 | 3.30 | 1.645 | 7.04 | 3.895 |
| 4 | 3.23 | 1.62 | 6.715 | 3.405 |
| 5 | 3.30 | 1.57 | 6.805 | 4.095 |

A higher $T_7$ nylon staple fiber is ring spun into nylon/cotton blend yarns with various nylon to cotton staple fiber ratios. Such yarns are compared in yarn strength to similar yarns prepared using nylon staple fibers of a more conventional $T_7$ value. Results are shown in Table 2.

TABLE 2

Comparison of Nylon Fiber Strength and % Nylon Content to Spun Yarn Strength (20/1 cc)

| | | Yarn Strength 45% Nylon/ 55% Cotton | | Yarn Strength 50% Nylon/ 50% Cotton | | Yarn Strength 55% Nylon/ 45% Cotton | |
|---|---|---|---|---|---|---|---|
| Ex. | $T_7$ | cN/Tex | Lea Product | cN/Tex | Lea Product | cN/Tex | Lea Product |
| 6 | 2.9 | 17.04 | 2742 | 17.31 | 2749 | 18.91 | 2977 |
| 7 | 3.4 | 17.18 | N/A | 18.5 | 3063 | 20.19 | 3257 |

Nylon staple fiber of 1.7 dpf and standard $T_7$ of 2.9 was ring spun into 50:50 nylon/cotton blend yarns of two different yarn counts. For comparison, nylon staple fiber of 1.6 dpf and a higher $T_7$ of 3.4 was ring spun into comparable nominal 50:50 nylon/cotton blend yarns. The same cotton type and yarn processing equipment was used in preparing all yarns. Such yarns are compared in yarn strength and evenness as shown in Table 3. Evenness is a measure of the variation in denier or diameter along the length of the yarn and is obtained by use of an Uster tester. The measurements reported were obtained with such an Uster tester based on an optical sensor, Model 5.

TABLE 3

Ring Spun Yarn Data

| | Yarn Count | | | |
|---|---|---|---|---|
| | 16/1 cc | | 20/1 cc | |
| | Example No. | | | |
| | Ex. 8- Standard | Ex. 9- High Strength | Ex. 10- Standard | Ex. 11- High Strength |
| dpf | 1.7 | 1.6 | 1.7 | 1.6 |
| Lea Product | 3149 | 3403 | 2993 | 3169 |
| Evenness CV % (coefficient of variation) | 10.93 | 10.94 | 11.57 | 12.09 |
| Tenacity (cN/tex) | 18.43 | 20.51 | 17.55 | 20.28 |

The yarns identified in Table 3 were woven into identical 2×1 twill fabric constructions. A standard weight and lighter weight fabric were made for comparison of both yarn types. In such fabrics the 20/1 count yarns were woven in the warp direction and the 16 or 20 count yarn were woven in the fill direction. Comparative and inventive fabric results are shown in Table 4. As seen, the higher strength fiber improved tensile, tear and flex abrasion results in all cases as compared to the standard strength fiber.

TABLE 4

Twill Fabric Comparison of Standard Versus High Strength Nylon Staple

| Example Number | 12 | 13 | 14 | 15 |
|---|---|---|---|---|
| Fabric Description | Standard Shirt Weight | Standard Shirt Weight | Lt Weight Shirt | Lt Weight Shirt |
| Nylon Fiber | Standard 1.7 | High Strength 1.6 | Standard 1.7 | High Strength 1.6 |
| Fabric Properties | | | | |
| Weight (oz/yd2) | 6.6 | 6.7 | 5.9 | 5.7 |
| Tensile ASTM D 5034 | | | | |
| Warp As Received (lbf) | 240 | 250 | 215 | 230 |
| Fill As Received (lbf) | 167 | 169 | 100 | 118 |
| Warp Laundered 20X (lbf) | 233 | 243 | 213 | 222 |
| Fill Laundered 20X (lbf) | 145 | 177 | 102 | 123 |
| Elmendorf Tear ASTM 1424 | | | | |
| Warp As Received (lbf) | 12.4 | 14.1 | 13.1 | 14.1 |
| Fill As Received (lbf) | 10.3 | 11.3 | 9 | 10.6 |
| Warp Laundered 20X (lbf) | 9.3 | 11.6 | 10.3 | 12.8 |
| Fill Laundered 20X (lbf) | 7.3 | 9.9 | 7.9 | 9.2 |
| Flex Abrasion ASTM D3885 | | | | |
| Warp As Received (cycles) | 60198 | 61583 | 54723 | 62462 |
| Fill As Received (cycles) | 63266 | 75108 | 50120 | 70502 |
| Warp laundered 20X (cycles) | 26009 | 32730 | 18180 | 20717 |
| Fill Laundered 20X (lcycles) | 18894 | 26725 | 17803 | 21526 |
| Construction | | | | |
| Warp | 102 | 102 | 102 | 100 |
| Fill | 61 | 61 | 57 | 57 |

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. A process for preparing nylon staple fibers having a load-bearing capacity of greater than 3.2 to 5.0 grams per denier measured as tenacity ($T_7$) at 7% elongation, said process comprising the steps of melt-spinning nylon polymer into filaments, quenching said filaments and forming one or more tows from a multiplicity of said quenched filaments, subjecting said tow(s) to drawing and annealing, and converting said drawn and annealed tow(s) into staple fibers suitable for forming into spun yarn comprising;

A) the nylon polymer melt spun into filaments has a formic acid relative viscosity (RV) of from 45 to 100;

B) said nylon polymer filaments are spun, quenched and formed into tows with both positional uniformity and uniformity of quenching conditions which are sufficient to permit use of draw ratios that provide the desired eventual staple fiber $T_7$ tenacity greater than 3.2 to 5.0 grams per denier;

C) the drawing and annealing of the tow(s) is carried out in a two-stage continuous operation conducted at a total effective draw ratio of from 2.3 to 5.0, said operation comprising a first drawing stage carried out at a temperature of from 80° C. to 125° C. wherein from 85% to 97.5% of the drawing of the tow(s) occurs and a second annealing and drawing stage wherein said tow(s) is/are subjected to an annealing temperature of from 145° C. to 205° C.; said operation being followed by a cooling step wherein said drawn and annealed tow(s) is/are cooled to a temperature of less than 80° C.; and D) the tow(s) is/are maintained under a controlled tension throughout said two stage continuous operation.

2. A process according to claim 1 wherein said staple fibers have a denier per filament of from 1.0 to 3.0 and a tenacity at break of at least 6.0 grams per denier.

3. A process according to claim 1, wherein the relative viscosity (RV) of the nylon polymer ranges from 45 to 65.

4. A process according to claim 1, wherein said staple fibers have a denier per filament of from 1.6 to 1.8, a tenacity at break of greater than 6.8 grams per denier, and a load-bearing capacity of from 3.3 to 4.5 grams per denier measured as tenacity ($T_7$) at 7% elongation.

5. A process according to claim 4 wherein said drawing and annealing of said multifilament tow is conducted at a total effective draw ratio of from 3.12 to 3.40.

6. A process according to claim 1 wherein said staple fibers have a denier per filament of from 2.3 to 2.7, a tenacity at break of from greater than 6.8 grams per denier, and a load-bearing capacity of from 3.3 to 5.0 grams per denier measured as tenacity ($T_7$) at 7% elongation.

7. A process according to claim 6 wherein said drawing and annealing of said multifilament tow is conducted at a total effective draw ratio of from 3.5 to 4.0.

8. A process according to claim 1 wherein said nylon polymer has an RV of from 50 to 60.

9. A process according to claim 1 wherein said first drawing stage is carried out at a temperature of from 80° C. to 125° C., and said second annealing and drawing stage is carried out at a temperature of from 165° C. to 205° C.

10. A process according to claim 1 wherein said nylon polymer is selected from the group consisting of polyhexamethylene adipamide (nylon 6,6) and polycaproamide (nylon 6).

11. Nylon staple fibers prepared by a process according to claim 1.

* * * * *